US007182796B2

(12) United States Patent
Kato

(10) Patent No.: US 7,182,796 B2
(45) Date of Patent: Feb. 27, 2007

(54) ODORANT FOR FUEL GAS

(75) Inventor: Yutaka Kato, Noda (JP)

(73) Assignee: Soda Aromatic Co., Ltd. (JP)

( * ) Notice: Subject to any disclaimer, the term of this patent is extended or adjusted under 35 U.S.C. 154(b) by 222 days.

(21) Appl. No.: 10/495,609

(22) PCT Filed: Nov. 22, 2002

(86) PCT No.: PCT/JP02/12228

§ 371 (c)(1),
(2), (4) Date: May 14, 2004

(87) PCT Pub. No.: WO03/044135

PCT Pub. Date: May 30, 2003

(65) Prior Publication Data

US 2005/0020479 A1 Jan. 27, 2005

(30) Foreign Application Priority Data

Nov. 22, 2001 (JP) ..... 2001-358590

(51) Int. Cl.
*C10L 8/00* (2006.01)

(52) U.S. Cl. ..... 44/349; 44/628; 44/357; 44/385; 44/388; 44/437; 44/438; 44/439; 44/450; 512/1

(58) Field of Classification Search ..... 44/448, 44/628, 349, 357, 385, 388, 437, 438, 439, 44/450; 512/1
See application file for complete search history.

(56) References Cited

U.S. PATENT DOCUMENTS 6,800,104 B2 * 10/2004 Rosenbaum ..... 44/448

* cited by examiner

*Primary Examiner*—Monique T. Cole
(74) *Attorney, Agent, or Firm*—DLA Piper US LLP

(57) ABSTRACT

The present invention provides an odorant suitable for use in fuel gases, such as liquefied natural gas (LNG), city gas, and LP gas, or methane gas, propane gas, butane gas and hydrogen gas. Preferably, the present invention provides a novel odorant that can also be used for fuel gases for fuel cells, including hydrogen gas. The odorant for fuel gases of the present invention has a perceptual threshold of 1 ppb or less, and includes a compound that has no sulfur atoms and no nitrogen atoms in its molecules. The odorant for fuel gases of the present invention is suitable for use in fuel cells that use hydrogen gas or other gases as a fuel.

8 Claims, No Drawings

ODORANT FOR FUEL GAS

TECHNICAL FIELD

The present invention relates to odorants for fuel gases, such as liquefied natural gas (LNG), city gas, and LP gas.

BACKGROUND ART

In general, odorants are added to fuel gases, such as liquefied natural gas (LNG), city gas, and LP gas, to prevent gas poisoning, ignition, explosion, or other accidents caused by fuel gases, and to enable immediate and easy detection of fuel-gas leakage by emitting an offensive smell.

Sulfur-containing compounds are widely known as odorants used for these fuel gases, but have problems in that they usually generate sulfur dioxide when the fuel gases are burned. In addition, when the fuel gases are used in fuel cells, which are being developed, a desulfurizer should be installed to remove odorant components that would cause catalyst poisoning. Various non-sulfur substances are also known as odorants. They include, for example, a mixture of valeric acid and ethyl acrylate (see patent document 1), cyclohexene (see patent document 2), an odorant essentially containing 5-ethylidene-2-norbornene (see patent document 3), a combined odorant of 2-methoxy-3-iso-butylpyrazine as a non-sulfur component and a mercaptan or a sulfide (see patent document 4), and pyrazine (see patent document 5).

However, these odorants have disadvantages in that, for example, acrylic ester odorants are chemically unstable, and that the content of cyclohexene or ethylidene norbornene is larger than those of mercaptans.

Alternatively, 5-ethylidene-2-norbornene and 2-alkoxy-3-alkylpyrazine are proposed as non-sulfur fuel-gas odorants with excellent odor characteristics (see patent document 6). However, 5-ethylidene-2-norbornene has a large perceptual threshold (about 4 ppb), and 2-alkoxy-3-alkylpyrazine has nitrogen atoms, wherein the perceptual threshold is defined in the present invention.

On the other hand, with the recent development of fuel cells, the variety of fuel gases has increased; for example, methane gas, propane gas, butane gas, LNG, and hydrogen gas. In addition, a larger number of applications are being developed for fuel gases. Accordingly, there is a need for novel fuel-gas odorants, especially for non-sulfur odorants.

(Patent document 1)
Japanese Unexamined Patent Application Publication No. 48-79804

(Patent document 2)
Japanese Unexamined Patent Application Publication No. 54-58701

(Patent document 3)
Japanese Unexamined Patent Application Publication No. 55-56190

(Patent document 4)
Japanese Unexamined Patent Application Publication No. 60-92396

(Patent document 5)
Japanese Unexamined Patent Application Publication No. 55-59190

(Patent document 6)
Japanese Unexamined Patent Application Publication No. 8-60167

DISCLOSURE OF INVENTION

Accordingly, it is an object of the present invention to provide a novel fuel-gas odorant that can solve the above-described problems.

Through an intense study that aimed to develop a sulfur- and nitrogen-free odorant with excellent odor characteristics, the present inventor has found that among these compounds, compounds with perceptual thresholds of 1 ppb or less can function sufficiently as the above-described fuel-gas odorants, and achieved the present invention based on the discovery of this fact. Thus, the fuel-gas odorant of the present invention contains compounds that have no sulfur and no nitrogen atoms in their molecules and have perceptual thresholds of 1 ppb or less. Compounds suitable for use in the fuel-gas odorant of the present invention will be detailed in the following description.

Furthermore, since the fuel-gas odorant of the present invention can be applied to fuel gases such as hydrogen gas, it is suitable for use in fuel gases for fuel cells that require sulfur-free fuel gases.

BEST MODE FOR CARRYING OUT THE INVENTION

The fuel-gas odorant of the present invention comprises compounds that have no nitrogen atoms in their molecules and can thereby suppress NOx emission. Furthermore, the fuel-gas odorant of the present invention comprises compounds that have no sulfur atoms in their molecules and thereby do not generate SOx. As a result, the fuel-gas odorant of the present invention does not cause sulfur-poisoning of catalysts used for fuel cells and can therefore be suitable for use in fuels for fuel cells.

For example, when sulfur-free fuel gases are used for fuel cells, the fuel-gas odorant of the present invention does not require a desulfurizer; a compact apparatus without a desulfurizer does not result in shortening the life of catalyst. Hence, the fuel-gas odorant of the present invention is particularly suitable for use in these applications.

The fuel-gas odorant should have the following desirable physical and functional properties.

(a) a low perceptual threshold
(b) preferably distinguishable from smells in daily life and functionable as a warning smell
(c) a low boiling point (in particular, this may be essential for hydrogen gas)
(d) low corrosivity
(e) causes little or no olfactory fatigue
(f) very low toxicity In the above-described requirements, a compound contained in the fuel-gas odorant of the present invention should have a perceptual threshold of 1 ppb or less, preferably 0.1 ppb or less. A perceptual threshold of more than 1 ppb will considerably increase the content of the compound per unit mass of, for example, hydrogen gas, to secure the perceptual concentration of the compound in case of leakage into the air. The increased amount of the compound will lead to separation of the compound from the hydrogen gas in a cylinder.

As used herein, a "perceptual threshold" of an odorant means the minimum concentration of the odorant in the air (vol./vol.) at which one can easily notice the smell of the odorant. For example, this value can be determined by several panelists who assess the olfactory intensity of a test substance in an odorless chamber. The air in the chamber is stirred until the concentration of the test substance becomes constant and is then left to stand. The olfactory intensity is assessed, for example, on a scale of 0 to 5 for smell pollution recommended by the Central Council for Environment Pollution Control in Japan.

An exemplary specific method for determining the perceptual threshold is as follows. A test odorant in a dish is left in an odorless chamber for a given period of time. After agitation of the air in the odorless chamber until the concentration of the test substance becomes constant followed by standing for 1 minute, panelists enter the chamber and assess the olfactory intensity on a scale of 0 to 5. This procedure is repeated at different concentrations of the test odorant. A perceptual threshold of the test odorant can be obtained by determining the concentration of the odorant corresponding to the olfactory intensity of 2, at which the smell can easily be identified as described below.

"Olfactory intensity on a scale of 0 to 5"

0: odorless
1: slight smell, but not identified.
2: easily noticed and can be identified.
3: obvious smell
4: strong smell
5: intolerably strong smell Furthermore, the fuel-gas odorant of the present invention is preferably distinguishable from smells in daily life and, in particular, is desirably functionable as a warning smell. Smells in daily life herein mean ordinary smells that are experienced in daily life situations and are not perceived as a foreign or unusual odor. On the other hand, a warning smell means a generally unpleasant smell that is perceived as an odor indicating unusual situations, clearly distinguishable from the smells in daily life, and can thereby be used as a warning signal.

In addition, the fuel-gas odorant of the present invention preferably has low corrosivity. Although the amount of an odorant in a fuel gas is very small, corrosion will accumulate in metals used for cylinders, pipes, valves and the like or in resins used for gaskets. Accordingly, the corrosivity should be as small as possible.

A preferred compound in the fuel-gas odorant of the present invention includes at least one selected from alcohols, such as nerol, 3-phenyl-1-propanol, linalool and geosmin; aldehydes, such as trans-2,trans-4-decadienal, trans-2,trans-4-hexadienal, trans-2,trans-4-octadienal, trans-2,trans-4-nonadienal, ethyl vanillin, cis-3-hexenal, trans-4-hexenal, trans-2,cis-6-nonadienal and 4,5-epoxy-2-dodecenal; ethers, such as 1-methoxynaphthalene, 2-methoxynaphthalene and 1-ethoxynaphthalene; esters, such as propyl isovalerate, isopentyl isovalerate, methyl dodecanoate, ethyl dodecanoate, ethyl undecanoate, methyl heptyne carboxylate and di-(2-methoxy phenyl) carbonate; fatty acids, such as butyric acid, isovaleric acid and 2-methyl propionic acid; ketones, such as 3-methyl-nonane-2,4-dione, 1-nonene-3-one, 3-hydroxy-4,5-dimethyl-2(5H)-furanone, 3-hydroxy-4,5-diethyl-2(5H)-furanone, 3-hydroxy-4-methyl-5-ethyl-2(5H)-furanone, 3-hydroxy-4-ethyl-5-methyl-2(5H)-furanone, 3-hydroxy-4-methyl-5-butyl-2(5H)-furanone, 3-hydroxy-4-methyl-5-isobutyl-2(5H)-furanone, 3-hydroxy-4-methyl-5-propyl-2(5H)-furanone, 2,5-dimethyl-4-methoxy-3(2H)-furanone, α-ionone, β-ionone, (E)-β-damascenone, trans-2-nonene-4-one, furaneol, and 1-(2,2,6-trimethyl cyclohexyl)-2-butene-one; phenols, such as p-cresol, 3,5-dimethyl phenol, 3-ethyl phenol and 1-naphthol; lactones, such as 3,6-dimethyl-3a,4,5,7a-tetrahydro-2(3H)-benzofuranone, γ-nonalactone, γ-undecalactone, (Z)-6-dodeceno-γ-lactone, and coumarin; hydrocarbons, such as o-cymene; and pyrans, such as cis-rose oxide. The perceptual thresholds of all these compounds are not more than 1 ppb, as determined by the above-described measurement.

Among the compounds above, an example of a more preferred alcohol is geosmin. Likewise, a more preferred aldehyde includes at least one compound selected from trans-2,trans-4-decadienal, trans-2,trans-4-hexadienal, trans-2,trans-4-nonadienal, ethyl vanillin, trans-2,cis-6-nonadienal. A more preferred ester includes at least one compound selected from propyl isovalerate and isopentyl isovalerate. A more preferred fatty acid includes at least one compound selected from isovaleric acid and 2-methyl propionic acid. A more preferred ketone includes at least one compound selected from 1-nonene-3-one, 3-hydroxy-4,5-dimethyl-2(5H)-furanone, 3-hydroxy-4,5-diethyl-2(5H)-furanone, 3-hydroxy-4-methyl-5-ethyl-2(5H)-furanone, 3-hydroxy-4-ethyl-5-methyl-2(5H)-furanone, 3-hydroxy-4-methyl-5-butyl-2(5H)-furanone, 3-hydroxy-4-methyl-5-isobutyl-2(5H)-furanone, 3-hydroxy-4methyl-5-propyl-2(5H)-furanone, 2,5-dimethyl-4-methoxy-3(2H)-furanone, α-ionone, β-ionone, (E)-β-damascenone, and furaneol. A more preferred phenol includes p-cresol. A more preferred lactone includes at least one compound selected from 3,6-dimethyl-3a,4,5,7a-tetrahydro-2(3H)-benzofuranone, γ-nonalactone, and γ-undecalactone.

Among the compounds above, a most preferred aldehyde includes at least one compound selected from trans-2,trans-4-decadienal, trans-2,trans-4-nonadienal, and trans-2,cis-6-nonadienal. Likewise, a most preferred fatty acid includes at least one compound selected from isovaleric acid and 2-methyl propionic acid. A most preferred ketone includes at least one compound selected from 3-hydroxy-4,5-dimethyl-2(5H)-furanone and 3-hydroxy-4-ethyl-5-methyl-2(5H)-furanone. In addition to their low perceptual thresholds, these selected compounds are easily available and are not hazardous to handle.

These compounds may be used alone or in any combination.

The fuel-gas odorant of the present invention may be added to fuel gases according to various methods known in the art using odorizing devices and the like.

The fuel-gas odorant of the present invention is suitable for use in fuel gases, such as liquefied natural gas (LNG), city gas, and LP gas, or methane gas, propane gas, butane gas and hydrogen gas. In particular, the fuel-gas odorant of the present invention contains compounds that are free of sulfur and nitrogen, and do not cause poisoning of catalysts used in fuel cells. Accordingly, the odorant is suitable for use in fuels for fuel cells, such as hydrogen.

EXAMPLE

Methods to evaluate fuel-gas odorants and corrosion according to the present invention will be described below.

(A method to Evaluate Fuel-Gas Odorants)

A test substance is released in an 8 $m^3$ odorless chamber such that the concentration of the test substance in the air is 1,000 ppm. The air in the chamber is stirred until the concentration of the test substance becomes constant. After the chamber is left to stand for a given period of time, six skilled panelists enter the chamber to determine the olfactory intensity on a scale of 0 to 5 as described above. Measured values are assessed on average.

(A method to Evaluate Corrosion)

Experiments are carried out in the following procedures in accordance with JIS K2234 (Corrosion test for antifreezes in radiators).

1) Measure the length, width, and height of a platinum plate with a vernier caliper three times at three places for each. Average the values to obtain representative values.
2) Wash the platinum plate with a detergent and methanol, place it in a dryer at 50° C. for 2 hours, and then leave it to cool in a desiccator.
3) Weigh the platinum plate with a precision balance to a precision of 0.0001 g.
4) Dip the platinum plate in a sample.
5) After 40 days, take the platinum plate out of the sample, wash it with a detergent and methanol, and then weigh it.

Example 1

A small cylinder (LPG, W3.3) is charged with 20 μg of trans-2-,trans-4-decadienal (perceptual threshold: 87.0 ppt) and then with 29.34 g of propane gas. The odorant concentration in the gas is about 0.86 ppm. The cylinder is shaken for 30 seconds to mix the contents. Then, about half the contents are released in an 8 $m^3$ chamber such that the concentration of the gas in the chamber is 1,000 ppm. The air in the chamber is then stirred with a fan for 3 minutes. After the chamber is left to stand for 1 minute, six panelists determine the olfactory intensity on a scale of 0 to 5. The gas has an olfactory intensity of 2.75 on average and is recognized as a warning smell by all the panelists.

Example 2

A small cylinder (LPG, W3.3) is charged with 20 μg of trans-2-,trans-4-decadienal (perceptual threshold: 87.0 ppt) and then with 1.33 g of hydrogen gas. The odorant concentration in the gas is about 15.04 ppm. The cylinder is shaken for 30 seconds to mix the contents. Then, about half the contents are released in an 8 $m^3$ chamber such that the concentration of the gas in the chamber is 1,000 ppm. The air in the chamber is then stirred with a fan for 3 minutes. After the chamber is left to stand for 1 minute, six panelists determine the olfactory intensity on a scale of 0 to 5. The gas has the olfactory intensity of 2.75 on average and is recognized as a warning smell by all the panelists.

Example 3

A small cylinder (LPG, W3.3) is charged with 0.25 μg of 3-hydroxy-4-methyl-5-ethyl-2(5H)-furanone (perceptual threshold: 1.5 ppt) and then with 29.34 g of propane gas. The odorant concentration in the gas is about 0.01 ppm. The cylinder is shaken for 30 seconds to mix the contents. Then, about half the contents are released in an 8 $m^3$ chamber such that the concentration of the gas in the chamber is 1,000 ppm. The-air in the chamber is then stirred with a fan for 3 minutes. After the chamber is left to stand for 1 minute, six panelists determine the olfactory intensity on a scale of 0 to 5. The gas has the olfactory intensity of 2.66 on average and is recognized as a warning smell by all the panelists.

Example 4

A small cylinder (LPG, W3.3) is charged with 0.25 μg of 3-hydroxy-4-methyl-5-ethyl-2(5H)-furanone (perceptual threshold: 1.5 ppt) and then with 1.33 g of hydrogen gas. The odorant concentration in the gas is about 0.19 ppm. The cylinder is shaken for 30 seconds to mix the contents. Then, about half the contents are released in an 8 $m^3$ chamber such that the concentration of the gas in the chamber is 1,000 ppm. The air in the chamber is then stirred with a fan for 3 minutes. After the chamber is left to stand for 1 minute, six panelists determine the olfactory intensity on a scale of 0 to 5. The gas has the olfactory intensity of 2.66 on average and is recognized as a warning smell by all the panelists.

Example 5

A small cylinder (LPG, W3.3) is charged with 20 μg of trans-2-,trans-4-decadienal and 0.25 μg of 3-hydroxy-4-methyl-5-ethyl-2(5H)-furanone (perceptual threshold: 7.4 ppt) and then with 29.34 g of propane gas. The odorant concentration in the gas is about 0.69 ppm. The cylinder is shaken for 30 seconds to mix the contents. Then, about half the contents are released in an 8 $m^3$ chamber such that the concentration of the gas in the chamber is 1,000 ppm. The air in the chamber is then stirred with a fan for 3 minutes. After the chamber is left to stand for 1 minute, six panelists determine the olfactory intensity on a scale of 0 to 5. The gas has the olfactory intensity of 3.2 on average and is recognized as a warning smell by all the panelists.

Example 6

A small cylinder (LPG, W3.3) is charged with 5.4 μg of isovaleric acid (perceptual threshold: 47.3 ppt) and then with 1.33 g of hydrogen gas. The odorant concentration in the gas is about 3.76 ppm. The cylinder is shaken for 30 seconds to mix the contents. Then, about half the contents are released in an 8 $m^3$ chamber such that the concentration of the gas in the chamber is 1,000 ppm. The air in the chamber is then stirred with a fan for 3 minutes. After the chamber is left to stand for 1 minute, six panelists determine the olfactory intensity on a scale of 0 to 5. The gas has the olfactory intensity of 2.40 on average and is recognized as a warning smell by all the panelists.

Example 7

A small cylinder (LPG, W3.3) is charged with 5.0 μg of γ-undecalactone (perceptual threshold: 22.8 ppt) and then with 1.33 g of hydrogen gas. The odorant concentration in the gas is about 3.76 ppm. The cylinder is shaken for 30 seconds to mix the contents. Then, about half the contents are released in an 8 $m^3$ chamber such that the concentration of the gas in the chamber is 1,000 ppm. The air in the chamber is then stirred with a fan for 3 minutes. After the chamber is left to stand for 1 minute, six panelists determine the olfactory intensity on a scale of 0 to 5. The gas has the olfactory intensity of 2.40 on average and is recognized as a warning smell by all the panelists.

Example 8

A small cylinder (LPG, W3.3) is charged with 7.50 μg of p-cresol (perceptual threshold: 51.3 ppt) and then with 1.33 g of hydrogen gas. The odorant concentration in the gas is about 5.64 ppm. The cylinder is shaken for 30 seconds to mix the contents. Then, about half the contents are released in an 8 $m^3$ chamber such that the concentration of the gas in the chamber is 1,000 ppm. The air in the chamber is then stirred with a fan for 3 minutes. After the chamber is left to stand for 1 minute, six panelists determine the olfactory intensity on a scale of 0 to 5. The gas has the olfactory intensity of 2.24 on average and is recognized as a warning smell by all the panelists.

Example 9

Platinum plates with surface areas of about 8 $cm^2$, and weights of about 1.5 g to 1.7 g as shown in Table 1 were prepared. A corrosion test was performed by dipping these plates in the samples shown in Table 1 at room temperature (average temperature: 29.9° C.) for 40 days. Ethane thiol was used as a control (comparative example).

TABLE 1

| Sample | Length (cm) | Width (cm) | Thick-ness (cm) | Surface Area ($cm^2$) | Weight before dipping (g) | Weight after dipping (g) | Difference in weight (g) |
|---|---|---|---|---|---|---|---|
| (Blank) | 1 | 4.04 | 0.01 | 8.28 | 1.5532 | 1.5532 | 0 |
| Ethane thiol | 0.98 | 4.03 | 0.01 | 8.1 | 1.6294 | 1.6290 | −0.0004 |
| Isovaleric acid | 1.01 | 4.05 | 0.01 | 8.38 | 1.7291 | 1.7291 | 0 |
| 3-hydroxy-4,5-dimethyl-2(5H)-furanone | 0.99 | 4.04 | 0.01 | 8.44 | 1.6956 | 1.6956 | 0 |

As shown in Table 1, no reduction in weight by dipping the platinum plates in each sample for 40 days was observed for blank (untreated), 3-hydroxy-4,5-dimethyl-2(5H)-furanone and isovaleric acid, while the control ethane thiol showed a reduction of 0.0004 g.

Accordingly, 3-hydroxy-4,5-dimethyl-2(5H)-furanone and isovaleric acid are not corrosive to platinum, which is commonly used as a catalyst in fuel cells, and thus do not cause catalyst poisoning. They are therefore suitable for use in fuels for fuel cells.

INDUSTRIAL APPLICABILITY

The fuel-gas odorant of the present invention comprises compounds that have no nitrogen atoms in their molecules and can thereby suppress NOx emission. Furthermore, the fuel-gas odorant of the present invention comprises compounds that have no sulfur atoms in their molecules and thereby do not generate SOx. As a result, the fuel-gas odorant of the present invention does not cause sulfur-poisoning of catalysts used for fuel cells and can therefore be suitable for use in fuels for fuel cells, such as hydrogen gas.

The invention claimed is:

1. Fuel comprising fuel gas and an amount of an odorant comprising a compound that has a perceptual threshold of 1 ppb or less, and has no sulfur atoms and no nitrogen atoms in its molecules, that is effective to impart an unpleasant smell to the fuel.

2. Fuel comprising fuel gas and an amount of an odorant for a fuel gas comprising at least one compound selected from nerol, 3-phenyl-1-propanol, geosmin, trans-2,trans-4-decadienal, trans-2,trans-4-hexadienal, trans-2,trans-4-octadienal, trans-2, trans-4-nonadienal, ethyl vanillin, cis-3-hexenal, trans-4-hexenal, trans-2,cis-6-nonadienal, 4,5-epoxy-2-dodecenal, 1-methoxy naphthalene, 2-methoxy naphthalene, 1-ethoxy naphthalene, propyl isovalerate, isopentyl isovalerate, methyl dodecan-oate, ethyl dodecanoate, ethyl undecanoate, methyl heptyne carboxylate, di-(2-methoxy phenyl) carbonate, butyric acid, isovaleric acid, 2-methyl propionic acid, 3-methyl-nonane-2,4-dione, 1-nonene-3-one, 3-hydroxy-4,5-dimethyl-2(5H)-furanone, 3-hydroxy-4,5-diethyl-2(5H)-furanone, 3-hydroxy-4-methyl-5-ethyl-2(5H)-furanone, 3-hydroxy-4-ethyl-5-methyl-2(5H)-furanone, 3-hy-droxy-4-methyl-5-butyl-2(5H)-furanone, 3-hydroxy-4-methyl-5-isobutyl-2(5H)-furanone, 3-hydroxy-4-methyl-5-propyl-2(5H)-furanone, 2,5-dimethyl-4-methoxy-3(2H)-furanone, α-ionone,(E)-β-damascenone, trans-2-nonene-4-one, furaneol, 1-(2,2,6-trimethyl cyclohexyl)-2-butene-one, p-cresol, 3,5-dimethyl phenol, 3-ethyl phenol, 1-naphthol, 3,6-dimethyl-3a,4,5,7a-tetrahydro-2(3H)-benzofuranone, γ-nonalactone, γ-undecalactone, (Z)-6-dodeceno-γ-lactone, o-cymene, and cis-rose oxide, that is effective to impart an unpleasant smell to the fuel.

3. Fuel comprising fuel gas and an amount of an odorant for a fuel gas comprising at least one compound selected from geosmin, trans-2,trans-4-decadienal, trans-2,trans-4-hexadienal,trans-2,trans-4-nonadienal, ethyl vanillin, trans-2,cis-6-nonadienal, propyl isovalerate, isopentyl isovalerate, isovaleric acid, 2-methyl propionic acid, 1-nonene-3-one, 3-hydroxy-4,5-dimethyl-2(5H)-furanone, 3-hydroxy-4,5-diethyl-2(5H)-furanone, 3-hydroxy-4-methyl-5-ethyl-2(5H)-furanone, 3-hydroxy-4-ethyl-5-methyl-2(5H)-furanone, 3-hydroxy-4-methyl-5-butyl-2(5H)-furanone, 3-hydroxy-4-methyl-5-isobutyl-2(5H)-furanone, 3-hydroxy-4-methyl-5-propyl-2(5H)-furanone, 2,5-dimethyl-4-methoxy-3(2H)-furanone, α-ionone, (E)-β-damascenone, furaneol, p-cresol, 3,6-dimethyl-3a,4,5,7a-tetrahydro-2(3H)-benzofuranone, γ-nonalactone, and γ-undecalactone, that is effective to impart an unpleasant smell to the fuel.

4. Fuel comprising fuel gas and an amount of an odorant for a fuel gas comprising at least one compound selected from trans-2,trans-4-decadienal, trans-2,trans-4-nonadienal, trans-2,cis-6-nonadienal, isovaleric acid, 2-methylpropionic acid, 3-hydroxy-4,5-dimethyl-2(5H)-furanone, and 3-hydroxy-4-ethyl-5-methyl-2(5H)-furanone, that is effective to impart an unpleasant smell to the fuel.

5. Fuel according to any of claims 1 to 4, wherein the fuel gas is hydrogen.

6. Fuel according to any of claims 1 to 4 for a fuel cell.

7. Fuel according to any of claims 1 to 4, wherein the fuel gas is LP gas.

8. Fuel according to any of claims 1 to 4, wherein the fuel gas is liquefied natural gas.

* * * * *